US010978812B2

(12) United States Patent
Jain et al.

(10) Patent No.: US 10,978,812 B2
(45) Date of Patent: Apr. 13, 2021

(54) SINGLE LAYER SHARED APERTURE DUAL BAND ANTENNA

(71) Applicant: DIRECTOR GENERAL, DEFENCE RESEARCH & DEVELOPMENT ORGANISATION (DRDO), New Delhi (IN)

(72) Inventors: Sachin Jain, Telangana (IN); Siva Rami Reddy G, Telangana (IN); Pummy Ratna, Telangana (IN); Usha P. Verma, Telangana (IN)

(73) Assignees: DIRECTOR GENERAL, DEFENCE RESEARCH & DEVELOPMENT ORGANISATION (DRDO), New Delhi (IN); MINISTRY OF DEFENCE, GOVT. OF INDIA, New Delhi (IN)

( * ) Notice: Subject to any disclaimer, the term of this patent is extended or adjusted under 35 U.S.C. 154(b) by 19 days.

(21) Appl. No.: 16/342,232

(22) PCT Filed: Oct. 12, 2017

(86) PCT No.: PCT/IB2017/056308
§ 371 (c)(1),
(2) Date: Apr. 16, 2019

(87) PCT Pub. No.: WO2018/073701
PCT Pub. Date: Apr. 26, 2018

(65) Prior Publication Data

US 2019/0252798 A1 Aug. 15, 2019

(30) Foreign Application Priority Data

Oct. 17, 2016 (IN) ..... 201611035468

(51) Int. Cl.
*H01Q 21/06* (2006.01)
*H01Q 1/42* (2006.01)
(Continued)

(52) U.S. Cl.
CPC ..... *H01Q 21/065* (2013.01); *H01Q 1/42* (2013.01); *H01Q 5/10* (2015.01); *H01Q 5/40* (2015.01);
(Continued)

(58) Field of Classification Search
CPC ..... H01Q 21/065; H01Q 13/20; H01Q 5/40; H01Q 9/0407; H01Q 5/10; H01Q 9/045; H01Q 1/42; H01Q 21/0075; H01Q 1/286
(Continued)

(56) References Cited

U.S. PATENT DOCUMENTS 5,160,936 A 11/1992 Braun et al.
5,508,710 A * 4/1996 Wang ..... H01Q 7/00 343/726
(Continued)

FOREIGN PATENT DOCUMENTS

CN 105609950 A 5/2016
WO 2015/127625 A1 9/2015

OTHER PUBLICATIONS

International Search Report dated Feb. 6, 2018 from corresponding International Patent Application No. PCT/IB2017/056308, 4 pages.
(Continued)

*Primary Examiner* — Don P Le
(74) *Attorney, Agent, or Firm* — Ohlandt, Greeley, Ruggiero and Perle, LLP

(57) ABSTRACT

Embodiment of the present disclosure relates to a shared aperture antenna for continuous transmission of signal to ground station at two different spot frequencies. The antenna provides a broad side radiation pattern for frequency range
(Continued)

of S band and squinted radiation pattern for frequency range of Ka band. The dual band microstrip antenna is configured on a single layer substrate, having a rectangular slot at small offset from the center on low frequency radiating patch. The positioning of radiating patch and length of high impedance microstrip feed are adjusted to fit into the slot and to get desired squint at high frequency. Two separate coaxial feeds are provided to excite the antenna independently. Third feed fulfil the termination needed by travelling wave array which increases the impedance bandwidth of antenna. A radome is provided to protect the radiating element from environment.

10 Claims, 4 Drawing Sheets

(51) Int. Cl.

| | |
|---|---|
| ***H01Q 21/00*** | (2006.01) |
| ***H01Q 13/20*** | (2006.01) |
| ***H01Q 5/40*** | (2015.01) |
| ***H01Q 9/04*** | (2006.01) |
| ***H01Q 5/10*** | (2015.01) |

(52) U.S. Cl.
CPC ..... *H01Q 9/045* (2013.01); *H01Q 9/0407* (2013.01); *H01Q 13/20* (2013.01); *H01Q 21/0075* (2013.01)

(58) Field of Classification Search
USPC ..... 343/777 MS, 700 MS
See application file for complete search history.

(56) References Cited

U.S. PATENT DOCUMENTS

| | | | | |
|---|---|---|---|---|
| 6,788,258 | B2 | 9/2004 | Olson | |
| 7,872,606 | B1 * | 1/2011 | Cheng | H01Q 1/38 343/700 MS |
| 8,264,410 | B1 * | 9/2012 | Wang | H01Q 1/38 343/700 MS |
| 10,003,132 | B2 | 6/2018 | Du et al. | |
| 10,468,780 | B1 * | 11/2019 | Milroy | H01Q 1/42 |
| 2002/0167449 | A1 * | 11/2002 | Frazita | H01Q 15/246 343/756 |
| 2012/0194406 | A1 * | 8/2012 | Brown | H01Q 5/42 343/876 |
| 2012/0299795 | A1 * | 11/2012 | Wang | H01Q 5/28 343/850 |
| 2014/0071005 | A1 * | 3/2014 | Wang | H01Q 21/28 343/725 |
| 2015/0226846 | A1 * | 8/2015 | Tedeschi | H01Q 9/285 342/368 |
| 2016/0365647 | A1 * | 12/2016 | Du | H01Q 25/00 |
| 2017/0294705 | A1 * | 10/2017 | Khripkov | H01Q 21/24 |
| 2019/0190156 | A1 * | 6/2019 | Kim | H01Q 9/0407 |
| 2020/0076086 | A1 * | 3/2020 | Cheng | H01Q 9/0421 |

OTHER PUBLICATIONS

Written Opinion dated Feb. 6, 2018 from corresponding International Patent Application No. PCT/IB2017/056308, 3 pages.

Bafrooei, et al.; "Characteristics of a Single- and Double-Layer Microstrip Square-Ring Antennas"; IEEE Transactions on Antennas and Propogation, vol. 47, No. 10, Oct. 1999, pp. 1633-1639.

Colangelo et al.; "Shared Aperture Dual Band Printed Antenna"; IEEE International Conference on Electromagnetics in Advanced Applications, 2011, pp. 1092-1095.

Lee et al.; "Experimental Study of the Two-Layer Electromagnetically Coupled Rectangular Patch Antenna", IEEE Transactions on Antennas and Propogation, vol. 38, No. 8, Aug. 1990, pp. 1298-1302.

* cited by examiner

SINGLE LAYER SHARED APERTURE DUAL BAND ANTENNA

The following specification particularly describes the invention and the manner in which it is to be performed.

TECHNICAL FIELD

Embodiment of the present disclosure relates to an antenna in a communication system. More particularly, embodiments of the disclosure relate to a dual band shared aperture antenna.

BACKGROUND

Communication systems need antennas which can perform multi functionality operation, and are also light weight, less mounting complexity and easier to make conformal to embed it with any surface to avoid aerodynamic disturbance due to protrusion. Airborne vehicles are equipped with various one way and two-way communication systems to communicate with the ground station for telemetry and transponder applications. They operate in different frequency bands and require different radiation patterns and polarizations therefore uses separate antennas to receive and transmit signal. As a consequence, it increases integration complexity and weight of the system. Evolution of multifunction antenna is slowly replacing the multiple individual antennas with single multifunction antenna which reduces the weight, mounting space occupied by antennas and RF signature of the system.

The multifunctional antenna uses time sharing of aperture and sharing of antenna aperture. The time sharing of aperture leads to transmission of data sequentially utilizing the same antenna having multiband or reconfigurability features. The sharing of antenna aperture involves transmission of data continuously employing separate radiating elements on single antenna aperture. The shared aperture antenna can be used to transmit at one frequency and receive at another frequency simultaneously or it can transmit two different frequency signals at the same time.

There exist conformal multifunction shared aperture models in combination of spiral mode microstrip antenna with loop antenna to receive signal above 300 MHz and in the FM band respectively. This antenna provides the use of frequency independent spiral as radiating element that radiates circularly polarized electromagnetic (EM) wave.

Known in the art is a concept of shared aperture in cavity backed slot antenna in array configuration, which operates in nearby UHF, S and L band using dual band or tri band feed network. These antennas are usually high directivity type and not suitable for Omni directional or broad beamed operation. Further, there exists a dual band shared aperture antenna designed in multilayer substrate integrated waveguide technology and working at X and Ka band frequencies. The concept of partially shared aperture antenna is also reported which has air-loaded microstrip stacked patch as radiating elements in array configuration, each including a driver patch and a parasitic patch spaced from ground plane through spacers. The multilayer antennas are generally needed considerable depth at mounting location to make it conformal to the vehicle surface.

REFERENCES

1. Braun et at, "Multiband shared aperture array antenna", U.S. Pat. No. 5,160,936A, 3 Nov. 1992.
2. Wang et al., "Conformal Multifunction Shared aperture antenna", U.S. Pat. No. 5,508,710A, 16 Apr. 1996.
3. Steven C. Olson., "Partially Shared Antenna Aperture", U.S. patent application Ser. No. 10/408,334, 9 Oct. 2003.
4. Pedram Moosavi Bafrooei, student member, IEEE, and Lotfollah Shafai, fellow, IEEE, "Characteristics of single- and double-layer microstrip square-ring antennas", IEEE Transactions on Antennas and propagation, VOL. 47 No. 10 Oct. 1999.
5. Giuseppe Colangelo and Roberto Vitiello, "Shared Aperture Dual Band Printed Antenna", IEEE International conference on Electromagnetics in Advanced Applications 2011, pp. 1092-1095.
6. Richard Q Lee, Kai Fong Lee, "Experimental study of the two layer electromagnetically coupled rectangular patch antenna", IEEE transactions on antenna and propagation, Vol. 38, No. 8, August 1990.

SUMMARY

The shortcomings of the prior art are overcome and additional advantages are provided through the provision of method of the present disclosure.

Additional features and advantages are realized through the techniques of the present disclosure. Other embodiments and aspects of the disclosure are described in detail herein and are considered a part of the claimed disclosure.

One embodiment of the present disclosure is a microstrip antenna. The microstrip antenna comprises a single layer substrate comprising a plurality of radiating elements on top side of the substrate; an antenna ground on bottom side of the substrate, and a slot for shared aperture coplanar configuration, wherein the plurality of radiating elements shares the shared aperture for dual band; a plurality of coaxial feeds, each of the plurality of coaxial feeds for each of the plurality of radiating element are placed at opposite side of the antenna to provide an isolation; and a radome mounted on one side of the substrate for protection.

It is to be understood that the aspects and embodiments of the invention described above may be used in any combination with each other. Several of the aspects and embodiments may be combined together to form a further embodiment of the invention.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The novel features and characteristic of the disclosure are set forth in the appended claims. The embodiments of the disclosure itself, however, as well as a preferred mode of use, further objectives and advantages thereof, will best be understood by reference to the following detailed description of an illustrative embodiment when read in conjunction with the accompanying drawings. One or more embodiments are now described, by way of example only, with reference to the accompanying drawings.

Figure 1:
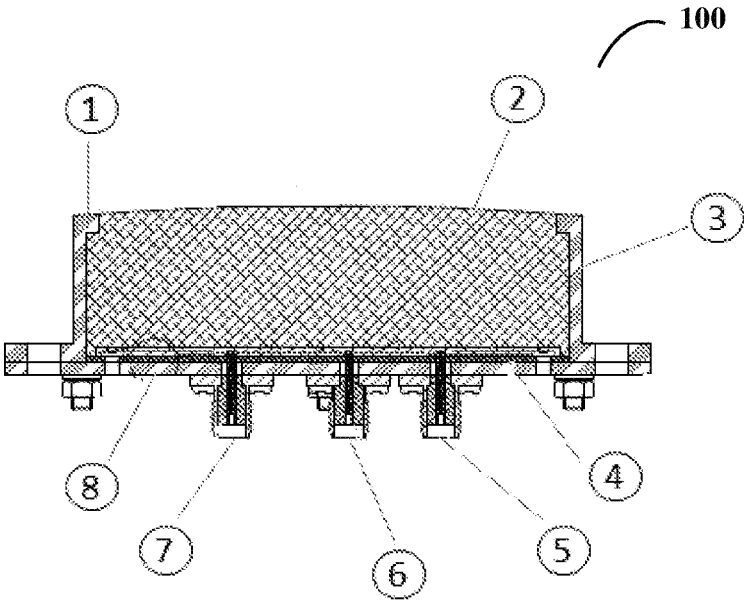
FIG. 1 shows an illustration of an exemplary dual band microstrip antenna on single layer substrate, in accordance with an embodiment of the present disclosure.

The figures depict embodiments of the disclosure for purposes of illustration only. One skilled in the art will readily recognize from the following description that alternative embodiments of the structures and methods illustrated herein may be employed without departing from the principles of the disclosure described herein.

DETAILED DESCRIPTION

The foregoing has outlined rather broadly the features and technical advantages of the present disclosure in order that the detailed description of the disclosure that follows may be better understood. Additional features and advantages of the disclosure will be described hereinafter which form the subject of the claims of the disclosure. The novel features which are believed to be characteristic of the disclosure, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present disclosure.

Embodiments of the present disclosure relate a single layer dual band shared aperture microstrip antenna on a substrate. The shared aperture antenna is used for continuous transmission of signals to a ground station at two different spot frequencies. The shared aperture reduces number of antennas required by a vehicle to half from separate antenna scheme without compromising the requirement of continuous transmission at both bands at the same time from antenna. The shared aperture antenna meets the requirement of broad side radiation pattern for frequency range of S band and squinted radiation pattern for frequency range of Ka band.

The shared aperture dual band microstrip antenna on single layer substrate is also referred as a microstrip antenna or shared aperture antenna or single layer antenna or antenna. The shared aperture antenna comprises a rectangular slot at small offset from the centre on low frequency radiating patch. The high frequency radiating elements forming a non-resonating travelling wave series fed array of two elements are placed inside the slot. The positioning of radiating patch and length of high impedance microstrip feed are adjusted to fit into the slot and to get desired squint at high frequency.

The antenna is configured with two separate coaxial feeds to excite the antenna independently. A third feed is configured to fulfil the termination needed by travelling wave array which increases the impedance bandwidth of antenna. The shared aperture antenna is placed inside a radome of predefined height, to protect the radiating element from environment. In one embodiment, the radome thickness may be increased or decreased based on at least one of the requirements, specification of the antenna and parameters of the antenna. However, to have a minimum transmission loss for the antenna the radome height is nearby a common integer multiple of $\lambda/2$ at both the bands. An aluminium housing designed in two parts to mount the antenna at airborne vehicle.

FIG. 1 shows an illustration of an exemplary dual band microstrip antenna on single layer substrate, in accordance with an embodiment of the present disclosure. As shown in FIG. 1, the dual band antenna 100 is printed on a low lossy material substrate 4 to reduce losses at Ka band. The thickness of substrate 4 is chosen to meet bandwidth requirement at S band and limit the generation of surface wave at Ka band, which contributes to the radiation of cross polarization from the antenna. The substrate 4 is a two-sided copper coated substrate for fabricating the antenna. At one side of the substrate 4 radiating elements are printed through chemical etching process and other side is made antenna ground. In one embodiment, the thickness of the copper foil is 0.017 mm, and it may be increased to have sufficient power handling capability. However, the thickness of the copper foils is thin in terms of wavelength, such as one hundredths of a wavelength.

The dual band microstrip antenna comprises a radome 2, which is placed on top of substrate 4 to protect antenna from external environment. Also, the radome 4 is configured with a curvature, to make it conformal to the mounting surface. The radome height is optimized to have minimum transmission loss at both the band. The RF transmission loss is nearly 0.5 dB and 1.5 dB at S and Ka bands respectively.

Also, the dual band microstrip antenna comprises a housing made in two parts, antenna back plate 8 and top cover 3. On one side of back plate 8 substrate is fixed with four screws and on other side coaxial connectors are mounted, in an embodiment. The dual band microstrip antenna is having a top housing holding a radome, which is fixed to back plate 8 using six countersunk holes. Two male steps 1 of arc 45 degree is provided towards non radiating edges of patch in top housing and corresponding female step in the radome to hold the radome rigidly without affecting E plane radiation pattern.

Figure 2:
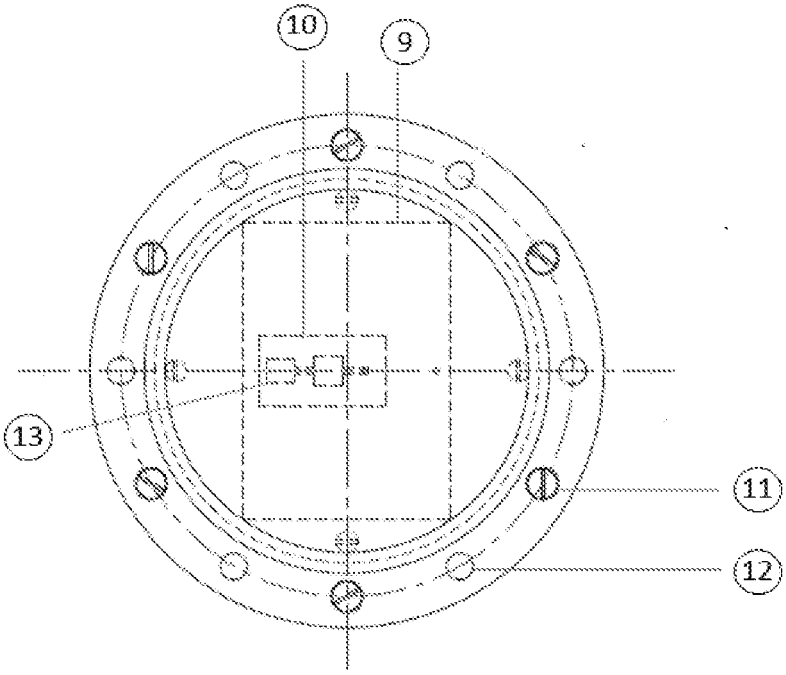
FIG. 2 shows plan view of printed element on the single layer substrate of the microstrip antenna without radome, in accordance with an embodiment of the present disclosure.

FIG. 2 shows plan view of printed element on the single layer substrate of the microstrip antenna without radome, in accordance with an embodiment of the present disclosure. As shown in FIG. 2, an S band copper patch 9 size is computed using a theoretical formulation, which needs a value of effective dielectric constant and spot frequency. A rectangular slot 10 is made at the centre of S band patch and length of the patch is further adjusted to the required operating frequency as slot in patch shift the resonance to lower frequency, such that $$L_e + \frac{W}{2} = \frac{\lambda}{2}$$

wherein, Le is length of the patch, W is width of the slot and λ is wavelength. 5 is coaxial feeding of signal at S band.

The electric fields at the centre of the resonating patch are minimum, removing metal portion of rectangular size from patch contribute to minimal change in radiation pattern characteristic of S band. However, with increase in size of perforation the antenna bandwidth and directivity decreases. The input impedance of the microstrip patch antenna becomes very high due to the perforation that makes antenna narrow band. The presence of the slot increases the current circulation length around the slot and shifts the resonant frequency towards lower side. As the length and width of the patch is reduced to tune the patch resonance at desired frequency, it reduces overall physical aperture of antenna which results in decrease in the directivity. The slot length is restricted to achieve bandwidth of 30 MHz at S band.

$$D_0 = 4\pi\frac{A_e}{\lambda^2}$$

wherein $D_0$ is directivity, $A_e$ is effective aperture of antenna.

Also, the antenna comprises a series fed patch array 13 at Ka band for 40° beam width at 6 dB down and squint of 50 deg from array axis with two elements, in one embodiment. The coaxial feed point 7 to the array has been provided directly to first patch instead of feeding through high impedance transmission line to avoid the requirement of larger slot length. In one embodiment, to achieve a higher impedance bandwidth of around 2 GHz other end of array is terminated to 50Ω which reduce the reflected power reaching to the feeding port. The isolation between ports 5 and 7 is improved by keeping the excitation of both the band opposite side.

Also, the single layer dual band shared aperture antenna provides a solution to the problem of combining antennas working at two different frequency bands, S and Ka, which are decade apart and having same polarization but different radiation pattern requirement on to a common aperture of single layer substrate. The two independent coaxial feeds are given to excite the elements separately that allow the continuous transmission of signal at both the bands. The radome is provided to protect the antenna from the environment and total antenna is retained inside housing made of aluminium material, in one embodiment of the present disclosure. The antenna may be made conformable easily to the surface of the airborne vehicle due to its single layer substrate design.

Also, the single layer dual band shared aperture antenna replaces the two antennas mounted on airborne vehicle for continuous transmission of signal to ground station at two different spot frequencies. This reduces the number of antennas required by vehicle to half from separate antenna scheme without compromising the requirement of continuous transmission at both bands at the same time from antenna. Also, the antenna meets the requirement of broad side radiation pattern for frequency range of S band and squinted radiation pattern for frequency range of Ka band.

The single layer dual band shared aperture antenna may be generalized and extended to design of antenna required to work at any two spot frequencies that are one decade apart. Also, the impedance bandwidth and radiation pattern may be realized as per the type of antenna used in the presented concept.

For the microstrip antenna, creation of the aperture is performed by cutting slot in lower frequency patch and placing higher frequency radiating element inside the slot in series fed array configuration to realize antenna in shared aperture concept. Both the frequencies of radiating elements are coplanar to realize antenna in single layer substrate. An offset of slot from antenna centre to mate the feed connections. The use of slot in rectangular patch to place higher frequency element in array form to get a squint of 40°.

In one embodiment of the present disclosure, the microstrip antenna comprises a miniaturization of S band patch in shared aperture coplanar configuration by using slot. A broad beamwidth coverage at both frequencies, S band antenna provides coverage at broadside and Ka band at an angle of 40° from broadside. The lower frequency patch is resonating type and higher frequency patch is non resonating type travelling wave array antenna. The high frequency radiating elements are arranged in non-resonant array configuration excited at one end and terminated at the other end to make it insensitive to reflections which relax fabrication tolerances. Misalignment of the layers which is common cause of performance degradation in electromagnetically coupled antenna is avoided by using single layer configuration in said antenna.

A plurality of coaxial feeds is provided for both operational frequencies are placed at opposite side in said antenna to have good isolation between them. The mutual coupling effect between the two frequencies radiating element is taken care in the design of said antenna. A transmission of linearly polarized wave by both the radiating elements continuously and simultaneously. E-plane of both the radiating element are aligned in the antenna. The design of antenna with radome in said configuration to protect it from environment after deployment. A mechanical housing which has two circular single steps of arc 45 deg at top cover towards non radiating edges of patch to hold radome without affecting E plane radiation pattern. The housing is designed to hold radome and antenna together and has mounting arrangement to deploy antenna on vehicle.

Figure 3:
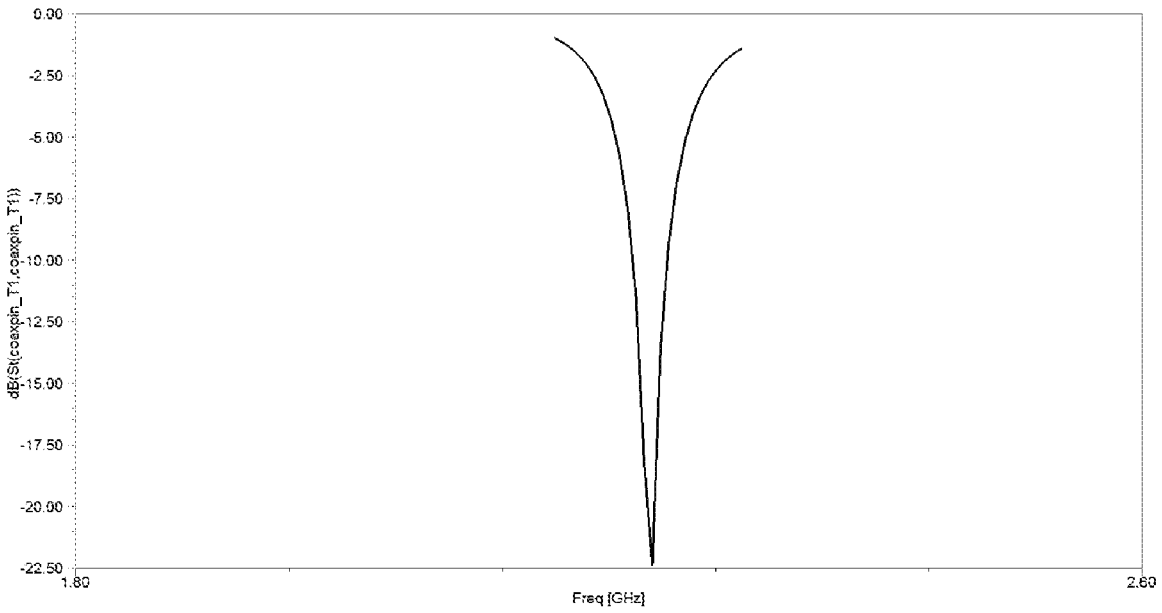
FIG. 3 shows an illustration of a S11 plot of the microstrip antenna in S band, in accordance with an embodiment of the present disclosure.
Figure 4:
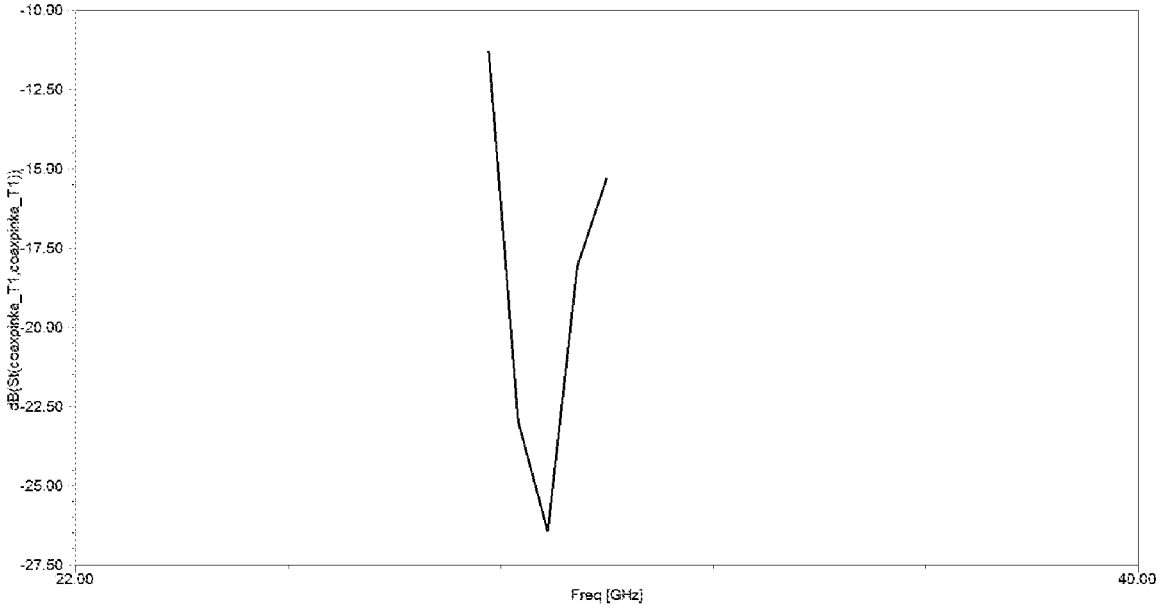
FIG. 4 shows an illustration of a S11 plot of the microstrip antenna in Ka band, in accordance with an embodiment of the present disclosure.

One embodiment is an antenna is tested, and return loss is measured which is better than 10 dB at both the operational frequencies. FIG. 3 shows an illustration of a S11 plot of the microstrip antenna in S band, in accordance with an embodiment of the present disclosure FIG. 4 shows an illustration of a S11 plot of the microstrip antenna in Ka band, in accordance with an embodiment of the present disclosure.

Figure 5:
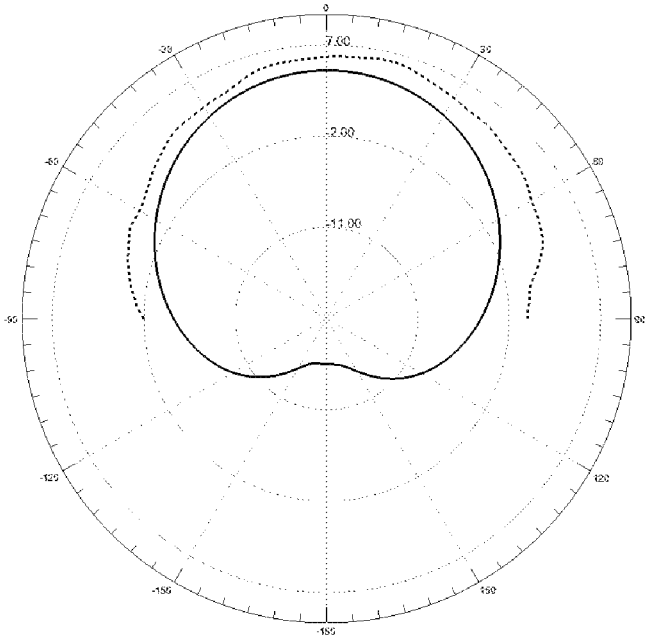
FIG. 5 shows simulated and measured radiation pattern of elevation plane of the microstrip antenna at S band, in accordance with an embodiment of the present disclosure.
Figure 6:
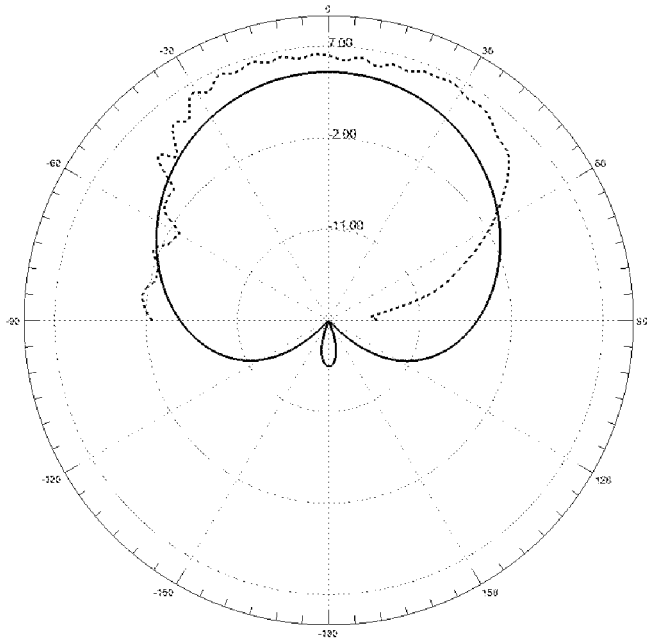
FIG. 6 shows simulated and measured radiation pattern of azimuth plane of the microstrip antenna at S band, in accordance with an embodiment of the present disclosure.

FIG. 5 shows simulated and measured radiation pattern of elevation plane of the microstrip antenna at S band, in accordance with an embodiment of the present disclosure. FIG. 6 shows simulated and measured radiation pattern of azimuth plane of the microstrip antenna at S band, in accordance with an embodiment of the present disclosure. At S band peak gain measured at boresight is 5.8 dBi. E plane and H plane 3 dB beam width is 106° and 90° as shown in FIG. 5 and FIG. 6.

Figure 7:
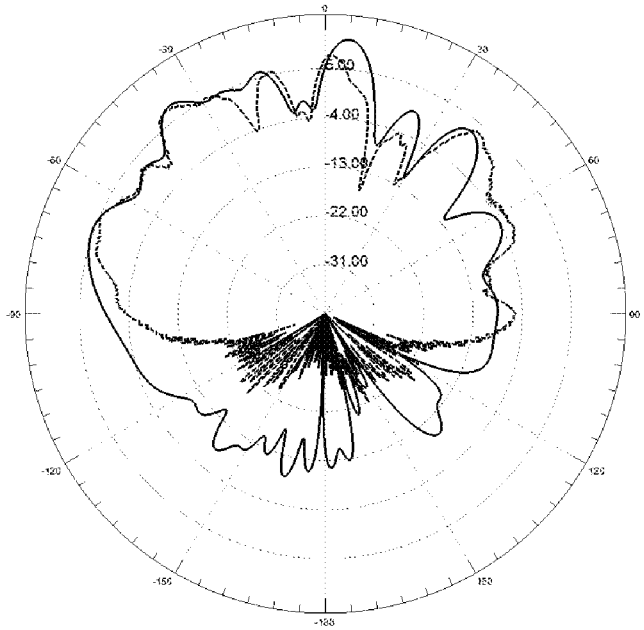
FIG. 7 shows simulated and measured radiation pattern of elevation plane at Ka band, of the microstrip antenna at S band, in accordance with an embodiment of the present disclosure.
Figure 8:
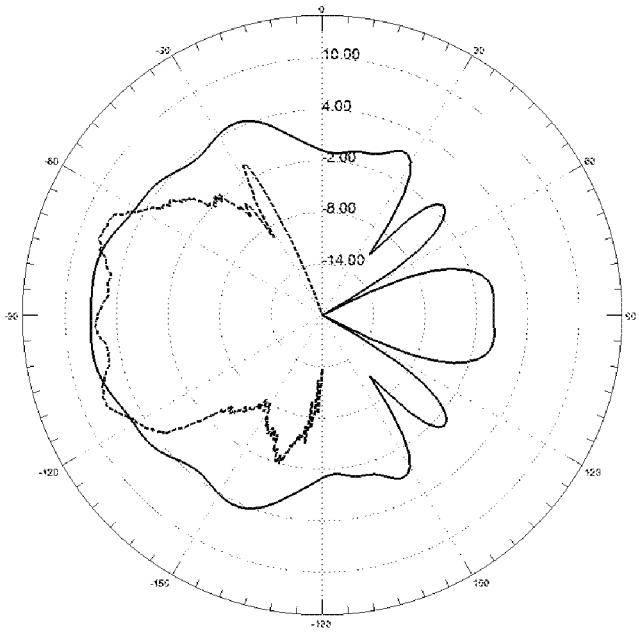
FIG. 8 shows simulated and measured radiation pattern of azimuth plane at Ka band, of the microstrip antenna at S band, in accordance with an embodiment of the present disclosure.

FIG. 7 shows simulated and measured radiation pattern of elevation plane at Ka band, of the microstrip antenna at S band, in accordance with an embodiment of the present disclosure. FIG. 8 shows simulated and measured radiation pattern of azimuth plane at Ka band, of the microstrip antenna at S band, in accordance with an embodiment of the present disclosure. At Ka band peak gain obtained is 6 dBi at 40° angle from boresight as shown in the FIG. 7 and ±20° beam width is achieved at 6 dB down from the peak gain in elevation plane. Azimuth plane beam width is ±45° as shown in FIG. 8.

Finally, the language used in the specification has been principally selected for readability and instructional purposes, and it may not have been selected to delineate or circumscribe the inventive subject matter. It is therefore intended that the scope of the invention be limited not by this detailed description, but rather by any claims that issue on an application based here on. Accordingly, the disclosure of the embodiments of the invention is intended to be illustrative, but not limiting, of the scope of the invention, which is set forth in the following claims.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

In addition, where features or aspects of the disclosure are described in terms of Markush groups, those skilled in the art will recognize that the disclosure is also thereby described in terms of any individual member or subgroup of members of the Markush group.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

The invention claimed is:

1. A microstrip antenna comprising:

a single layer substrate comprising:

a plurality of radiating elements on a top side of the substrate;

an antenna ground on a bottom side of the substrate, and a slot for a shared aperture coplanar configuration, wherein the plurality of radiating elements shares the shared aperture for dual band;

a plurality of coaxial feeds, each of the plurality of coaxial feeds for each of the plurality of radiating element are placed at opposite side of the antenna to provide an isolation; and a radome mounted on one side of the substrate for protection, wherein the antenna comprises a feed for termination of a travelling wave array which increases impedance bandwidth of the antenna.

2. The antennas as claimed in claim 1, wherein the shared aperture is created by cutting the slot in a lower frequency radiating element and placing a higher frequency radiating element inside the slot in a series fed array configuration.

3. The antennas as claimed in claim 1, wherein the plurality of radiating elements are three in number.

4. The antennas as claimed in claim 1, wherein the dual band of frequencies are S band and Ka band, wherein S band antenna provides broadside coverage and Ka band at an angle of 40° from broadside.

5. The antennas as claimed in claim 1, wherein the antenna provides at least one of broad side radiation pattern for a frequency range of S band and squinted radiation pattern for a frequency range of Ka band.

6. The antennas as claimed in claim 1, wherein the antenna generates radiating signals at two different frequencies which are one decade apart.

7. The antennas as claimed in claim 1, wherein the slot is configured at an offset from antenna center to connect a plurality of feed connections.

8. The antennas as claimed in claim 1, wherein the slot in a lower frequency radiating element is created to place a higher frequency radiating element in array form to obtain a squint of 40°.

9. The antennas as claimed in claim 1, wherein a lower frequency radiating element is a resonating type and a higher frequency radiating element is a non-resonating type travelling wave array antenna.

10. The antennas as claimed in claim 1,

A microstrip antenna comprising:

a single layer substrate comprising:

a plurality of radiating elements on a top side of the substrate;

an antenna ground on a bottom side of the substrate; and a slot for shared aperture coplanar configuration, wherein the plurality of radiating elements shares the shared aperture for dual band;

a plurality of coaxial feeds, each of the plurality of coaxial feeds for each of the plurality of radiating elements are placed at opposite side of the substrate to provide an isolation; and a radome mounted on one side of the substrate for protection, wherein the antenna comprises a mechanical housing having two circular single steps, on the top side towards non: radiating edges of the plurality of radiating elements to hold the radome without affecting E plane radiation pattern, and said housing holds the radome and the substrate together.

* * * * *